US005454447A

United States Patent [19]

Kulak et al.

[11] Patent Number: 5,454,447

[45] Date of Patent: Oct. 3, 1995

[54] ELEVATOR HOISTWAY DOOR BOLT LOCK

[75] Inventors: Richard E. Kulak, Bristol; Thomas M. McHugh, Farmington; Edward E. Ahigian, West Hartford; Jerome F. Jaminet, South Windsor; Thomas He, Unionville; Richard E. Peruggi, Glastonbury; Thomas M. Kowalczyk, Farmington; David W. Barrett, East Hartland, all of Conn.

[73] Assignee: Otis Elevator Company, Farmington, Conn.

[21] Appl. No.: 223,922

[22] Filed: Apr. 6, 1994

[51] Int. Cl.[6] ..... B66B 13/06

[52] U.S. Cl. ..... 187/331; 187/336; 187/340

[58] Field of Search ..... 187/61, 62, 63, 187/31, 33, 104, 331, 336, 340

[56] References Cited

U.S. PATENT DOCUMENTS 964,891 7/1910 Westlin ..... 187/61
1,679,092 7/1928 McCormick ..... 187/31 X
1,709,970 4/1929 Brubaker ..... 187/31
1,882,621 10/1932 Ives ..... 187/31
4,364,454 12/1982 Glaser et al. ..... 187/61 X
5,203,431 4/1993 Donohoe et al. ..... 187/31

FOREIGN PATENT DOCUMENTS 430028 11/1974 U.S.S.R. ..... 187/61 X

*Primary Examiner*—William E. Terrell
*Assistant Examiner*—Dean A. Reichard

[57] ABSTRACT

An elevator hoistway door lock comprises a rod journaled for rotation on a hoistway door. A pin which extends laterally from the rod engages a lip when the rod is rotated into a locked position by means of its own weight, and optionally a spring. The pin clears the lip when the rod is rotated into an unlocked position by means of a retiring cam disposed on the elevator car. The electrical safety switch contacts are interconnected by a rotating contact disposed on the rod, only when the rod is rotated to place the pin in the locked position.

9 Claims, 1 Drawing Sheet fig. 1
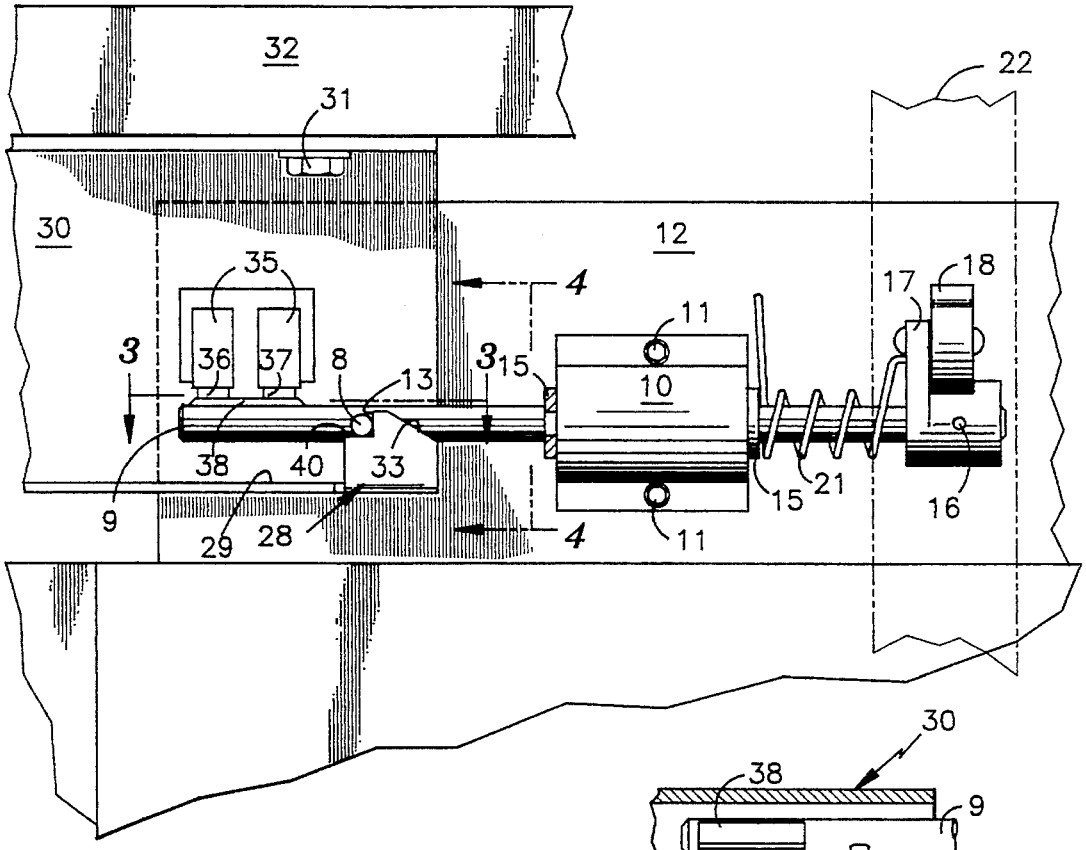
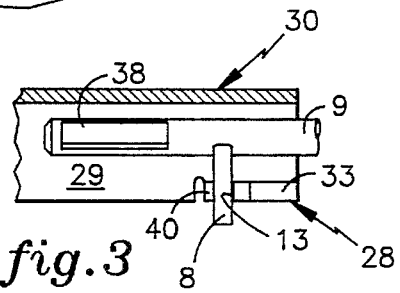
fig. 3
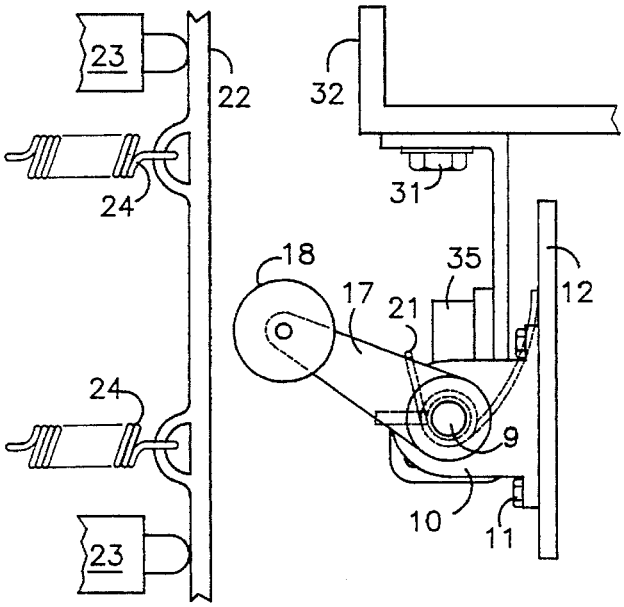
fig. 2
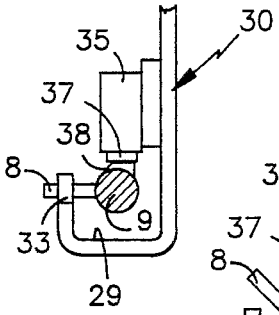
fig. 4
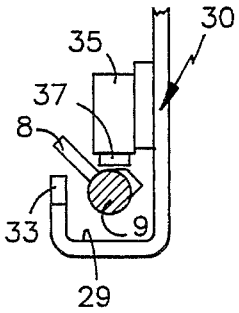
fig. 5

ELEVATOR HOISTWAY DOOR BOLT LOCK

TECHNICAL FIELD

This invention relates to a lock for securing elevator hoistway doors firmly in the closed position, except when unlocked by an adjacent elevator car to permit transfer of passengers between the car and the adjacent landing.

BACKGROUND ART

Modern elevator systems have doors to permit transfer of passengers between the elevator cars and the respective floor landings. Because smaller doors have to travel a lesser distance and have less inertia, many elevators have two doors. They may meet in the middle, and thereby have a lesser distance to travel or they may both travel to the same side for opening. Other elevators may have only a single door. As used herein, the term "door" or "doors" may be used interchangeably, it being understood that there is no distinction between a single door and double doors concerning the subject matter hereof.

Present day elevator systems have doors mounted on the elevator car, and doors mounted at each hall landing of the elevator hoistway. The hoistway doors at the hall landings are mounted directly to the building structure, and are kept closed whenever the car is not present at the related landing in order to prevent passengers and objects from entering the hoistway. Instead of having door operators for each of the hoistway doors, the hoistway doors are typically opened by coupling them with the car doors, so that opening of the car doors will open the landing doors in unison therewith, thereby protecting passengers in the car from the building structure and protecting passengers at the landing from the hoistway.

For safety reasons, and to comply with safety codes, whenever an elevator car is not adjacent to a landing, the hoistway doors must be safely locked in the closed position. One known type of door lock has a rotatable latch that engages a lip, the latch being rotated by a vane on the adjacent elevator car door, as the car door begins to move toward the open position. This type of lock, however, is useful only in a lost motion door coupling system (that is one in which the car door begins to move before it moves the hoistway door). For systems in which lost motion car door coupling is not permitted, because the resulting perturbations in the door operating system are to be avoided, the vane rotated latch cannot be used. Any mechanisms related to the elevator doors must not interfere with the passage of an elevator past the landing at relatively high speed.

A type of hoistway door lock which can unlock the hoistway door before elevator car door motion occurs utilizes a retiring cam. The retiring cam is mounted on the elevator car and is forced toward the hoistway door as soon as the car approaches the landing sufficiently close so as to begin advance door opening. The retiring cam rotates a member mounted on the hoistway door to unlock the hoistway door prior to any motion of the car door. However, such systems typically lock only one of the hoistway doors directly to the hoistway header or other building structure, and cause the other hoistway door to be locked thereto by a related mechanism of some form. Other devices of this type may require use of a very long rotating member which introduces installation and maintenance problems due to the requirement for critical alignment.

DISCLOSURE OF INVENTION

Objects of the invention include provision of a relatively simple, positive, hoistway door lock which may be used in systems that do not employ lost motion, which are simple to install and require little maintenance, and which allow self-closure and locking in the absence of the elevator car.

According to the present invention, an elevator hoistway door lock comprises a pin extending laterally from a rod that is rotatable by a cam follower in response to the retiring cam of an elevator engages a lip when rotated into a locked position, to positively lock a hoistway door to the hoistway structure. The rotating rod may also carry an electrical contact of the hoistway door safety switch to indicate door closure only when the pin is engaged with the lip.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1 is a side elevation view of an elevator hoistway door lock in accordance with the present invention.

FIG. 2 is a side elevation view of the elevator door lock of FIG. 1.

FIG. 3 is a partial, partially sectioned top view taken on the line 3—3 of FIG. 1.

FIG. 4 is a partial, partially sectioned side elevation view taken on the line 4—4 of FIG. 1.

FIG. 5 is a partial, partially sectioned side elevation view in the unlocked position.

BEST MODE FOR CARRYING OUT THE INVENTION

Referring now to FIG. 1, a pair of elevator hoistway doors 6, 7 are shown in the closed position, in which they must be locked for safety. A lock in accordance with the present invention comprises a pin 8 extending laterally from a rod 9 that is journaled for rotation in a pillow block 10 that is secured by bolts 11 to a hoistway door hanger 12. The pin 8 engages a lip 13 when locked. The rod 9 may be held in place with respect to the pillow block 10 by means of retaining rings 15. The rod 9 is secured, such as by a pin or screw 16, to a cam follower arm 17 to which a cam follower roller 18 is disposed for rotation. As shown in FIG. 2, the weight of the follower 17 and roller 18, together with a spring 21, ensures that the follower 17 will always remain in the position shown in FIGS. 1 and 2, thereby ensuring that the rod 9 will be in the position shown in FIGS. 1, 3 and 4, except when it is rotated clockwise (as seen in FIG. 2) by a retiring cam 22. If the weight of the follower 17 and roller 18 is sufficient to ensure return to the locked position, the spring 21 may be eliminated. Normally, the spring 21 will not be used. The retiring cam 22, shown dotted in FIG. 1 and only schematically in FIG. 2, is capable of being moved to the right (as seen in FIG. 2) by means of solenoid actuators 23, and to be automatically returned to the position shown in FIG. 2 by means of springs 24; the retiring cam 22 may be operated in any other known way.

When the elevator car is not within the landing zone (within which the doors are allowed to be opened), the solenoid actuators 23 will not be actuated, causing the retiring cam to be in a clearance position as shown in FIG. 2. When the car enters the landing zone, the actuators 23 will move the retiring cam 22 to the right, thereby rotating the rod 9 through about 45° in the clockwise direction. Because the car door engages the hoistway door by means of a coupling mechanism so that the car door will move the hoistway door open and closed in unison with it, the retiring cam 22 will remain engaged with the cam follower 18 throughout the door motion, thus retaining the pin 8 in the unlocked position, until, after the doors are closed, the retiring cam 22 is retired.

After passenger transfer, when the doors are fully closed, the retiring cam will again be allowed to be returned to the position shown in FIG. 2 by deactivation of the solenoid actuators 23, under the urging of the springs 24. The actuators 23 and springs 24 are secured to the elevator car (not shown, to the left of FIG. 2).

When in the locked position as shown in the figures, the pin 8 engages the lip 13 (FIGS. 1, 2 and 4) formed in a wall 28 which extends upwardly from a shelf 29 on a switch and lock assembly 30 that is supported by bolts 31 from the hoistway header 32. The wall 28 also has a ramp surface 33 that will raise the pin whenever the hoistway door is closing without the aid of the retiring cam 22, as in maintenance operations. Such action allows automatic door closures, such as by a weight, and automatic locking, as required by government codes. The assembly 30 also supports electrical switch contact holders 35 which position electrical contacts 36, 37 near the rod 9 so that current will flow between them through a rotating contact 38 only when the rod is in the locked position as shown. The wall 28 may also have a shelf 40 formed therein to act as a stop and hold the rod 9 in the correct rotation when the door is locked.

As evident in FIG. 5, when the retiring cam 22 rotates the follower arm so that the rod 9 is rotated clockwise by about 45°, the pin 8 will clear the lip 13 and the rotating contact 38 will no longer connect the switch contacts 36, 37.

The foregoing embodiment is exemplary merely, there being many details which can be altered to suit any implementation of the present invention.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator hoistway door lock comprising:

a lip disposed on a hoistway door header in the vicinity of a hoistway door at an elevator landing doorway with the hoistway door being movable between an open position and a closed position;

a rod journaled for rotation on the hoistway door in the vicinity of said lip;

a pin extending laterally outward from said rod in a position so as to be able to engage said lip when said hoistway door is in the closed position and thereby prevent the said hoistway door from moving toward the open position; and a cam follower fastened to said rod and movable between a first position in which said rod is rotated to a locked position in which said pin engages said lip and an unlocked position in which said pin clears said lip so that said hoistway door may be moved toward an open position, said cam follower being disposed in a position adjacent to the position at which a retiring cam of an elevator car will appear when the elevator car is within a landing zone of a landing to which said hoistway door corresponds, whereby, when an elevator car is within the landing zone of the related landing, the retiring cam may actuate said cam follower to rotate said rod into said unlocked position.

2. An elevator hoistway door lock comprising:

a lip disposed on a hoistway door header in the vicinity of a hoistway door at an elevator landing doorway with the hoistway door being movable between an open position and a closed position;

a rod journaled for rotation in a pillow block on the hoistway door in the vicinity of said lip;

a pin extending laterally outward from said rod in a position so as to be able to engage said lip when said hoistway door is in the closed position and thereby prevent the said hoistway door from moving toward the open position; and a cam follower fastened to said rod and movable between a first position in which said rod is rotated to a locked position in which said pin engages said lip and an unlocked position in which said pin clears said lip so that said hoistway door may be moved toward an open position, said cam follower being disposed in a position adjacent to the position at which a retiring cam of an elevator car will appear when the elevator car is within a landing zone of a landing to which said hoistway door corresponds, whereby, when an elevator car is within the landing zone of the related landing, the retiring cam may actuate said cam follower to rotate said rod into said unlocked position.

3. A hoistway door lock according to claim 2 wherein said hoistway door includes a hanger disposed thereon, and said pillow block is fastened to said hanger.

4. A hoistway door lock according to claim 1 further comprising:

a spring acting between said cam follower and said hoistway door so as to resiliently urge said cam follower to rotate said rod into said locked position.

5. An elevator hoistway door lock comprising:

a lip disposed on a hoistway door header in the vicinity of a hoistway door at an elevator landing doorway with the hoistway door being movable between an open position and a closed position;

a rod journaled for rotation on the hoistway door in the vicinity of said lip;

a pin extending laterally outward from said rod in a position so as to be able to engage said lip when said hoistway door is in the closed position and thereby prevent the said hoistway door from moving toward the open position;

a cam follower fastened to said rod and movable between a first position in which said rod is rotated to a locked position in which said pin engages said lip and an unlocked position in which said pin clears said lip so that said hoistway door may be moved toward an open position, said cam follower being disposed in a position adjacent to the position at which a retiring cam of an elevator car will appear when the elevator car is within a landing zone of a landing to which said hoistway door corresponds, whereby, when an elevator car is within the landing zone of the related landing, the retiring cam may actuate said cam follower to rotate said rod into said unlocked position;

a pair of electrical safety contacts displaced longitudinally of each other adjacent to said rod; and a rotating electrical contact extending outwardly from the periphery of said rod and having a limited arcuate extent, said contact disposed on the periphery of said rod so that when said rod is rotated into the locked position with said pin engaging said lip said rotating contact will electrically interconnect said electrical safety contacts, said rotating electrical contact being of limited arcuate extent so that when said rod is rotated into said unlocked position with said pin clearing said lip, said electrical safety contacts are not interconnected by said rotating electrical contact.

6. A hoistway door lock according to claim 5 wherein:

said landing doorway includes a hoistway header secured to the building structure; and said electrical safety contacts and said lip are disposed on a mount fastened to the header.

7. A hoistway door lock according to claim 4 wherein said spring is a spiral spring.

8. A hoistway door lock according to claim 1 wherein said cam follower is disposed to rotate under its own weight when not actuated by said retiring cam, thereby to rotate said rod into said locked position.

9. A hoistway door lock according to claim 1 wherein said lip is in a wall having a ramp surface that raises said pin over said lip whenever the hoistway door is closed with said cam not being rotated into said unlocked position by the retiring cam.

* * * * *